US006220596B1

(12) United States Patent
Horan

(10) Patent No.: US 6,220,596 B1
(45) Date of Patent: Apr. 24, 2001

(54) MATRIX GAME

(75) Inventor: Michael J. Horan, 24 NE. 16 *th* St., Pompano Beach, FL (US) 33062

(73) Assignee: Michael J. Horan

( * ) Notice: Subject to any disclaimer, the term of this patent is extended or adjusted under 35 U.S.C. 154(b) by 0 days.

(21) Appl. No.: 09/244,380

(22) Filed: Feb. 4, 1999

Related U.S. Application Data

(60) Provisional application No. 60/073,647, filed on Feb. 4, 1998.

(51) Int. Cl.[7] ..... A63F 3/06
(52) U.S. Cl. ..... 273/269; 273/139
(58) Field of Search ..... 273/269, 139

(56) References Cited

U.S. PATENT DOCUMENTS

| | | | | |
|---|---|---|---|---|
| 4,373,726 | | 2/1983 | Churchill et al. | 273/138 |
| 5,351,970 | | 10/1994 | Fioretti | 273/439 |
| 5,518,239 | * | 5/1996 | Johnston | 273/269 |
| 5,569,083 | | 10/1996 | Fioretti | 463/19 |
| 5,679,077 | | 10/1997 | Pocock et al. | 463/19 |
| 5,683,295 | | 11/1997 | Frain | 463/19 |
| 5,755,619 | | 5/1998 | Matsumoto et al. | 463/19 |
| 5,800,269 | | 9/1998 | Holch et al. | 463/42 |
| 5,830,063 | | 11/1998 | Byrne | 463/18 |
| 5,935,002 | | 8/1999 | Falciglia | 463/19 |

OTHER PUBLICATIONS 3M drawing 5300–PPF6.11, dated Apr. 21, 1991, pp. 1–2.

* cited by examiner

*Primary Examiner*—Benjamin H. Layno
(74) *Attorney, Agent, or Firm*—Sand & Sebolt; Daniel J. Long

(57) ABSTRACT

A game which is played on a matrix having three columns and three rows. There are a pair of headers on the opposed sides of the rows. There is also a header on the columns. The letters in BINGO are distributed in any five spaces in these eight header spaces. The players may select the numbers in the matrix. A game which has similarities to BINGO, but which provides additional variables and player participation is thereby provided.

10 Claims, 2 Drawing Sheets

MATRIX GAME

CROSS REFERENCE TO RELATED APPLICATION

This application claims priority rights under U.S. Provisional Application No. 60/073,647, Filed Feb. 4, 1998.

BACKGROUND OF THE INVENTION

1. Field of the Invention

The present invention relates to games and more particularly to bingo and games similar to bingo.

2. Brief Description of the Prior Art

Classic bingo, as the game is commonly played is purely a game of chance that incorporates the actual name "BINGO" as five separate distinct letters that are aligned with an assigned to fifteen separate numbers in and as part of each actual letter. The name "BINGO" appears both as a work and as a separately designated letter symbols at the top of every bingo card. Each letter is the guide call to each vertical column of five possible numbers from the fifteen assigned to each letter on any and all cards. The only other constant is "FREE" space in the center of each and every bingo card designated by the actual word symbol "FREE".

Even though the "FREE" designation space is under the letter "N", there are still fifteen separate distinct call numbers from thirty-one to forty-five even though only four number spaces are useable for play.

Traditionally, a bingo caller uses a mechanical and/or electronic draw to achieve the called letter number. The winner or winners are determined by covering only the numbers under the called letter in the word "BINGO" that completes or accomplishes a designated pattern on a specific game played. Even though the separate letters of the word "BINGO" at the top of every card along with the "FREE" space in the center of every card are constant (always and ever present and part of) designations and symbols used in every game of "BINGO", they do not determine a winner. Only combinations and patterns of numbers determine winners.

Even though bingo is a widely played and popular game, various players may enjoy functions which could be performed by the players and allow them to be more active participants.

There is, therefore, a need for a game which, although similar to bingo, allows for a faster more active game.

SUMMARY OF THE INVENTION

The present invention is a method of playing a game which includes the steps of:

(a) providing a first matrix having an array consisting of at least two columns of elements and at least two rows of elements, said columns and rows being arranged such that each of said elements is simultaneously included in one of said columns and one of said rows and is positioned adjacent to at least one of said elements so as to form primary predesignated sets of elements each of the elements in said primary predesignated sets being adjacent to at least one other of said elements in its said set and at least one of the columns has a designation selected form a first class of designation selected from a combination of said first class of designations and a second class of designations wherein the designation from the first class of designations is based on a special relationship of the elements and one of the designations used for the columns and rows;

(b) causing a first player to be associated by a physical means with said first matrix by having said first player assigned to a first position adjacent said first matrix; and (c) generating a random set of elements by identifying a plurality of combinations of the first and second classes of designations and declaring a winning combination if said random set of elements matches any one of the primary predesignated sets of elements and wherein if the random set of elements generated in this step does not match either any one of the primary predesignated sets of elements, further random sets of elements are successively randomly generated until one of said further random sets of elements matches any one of the primary predesignated sets of elements and the first player wins when one of said random sets of elements matches any one of the primary predesignated sets of elements.

BRIEF DESCRIPTION OF THE DRAWINGS

The application is further described with reference to the accompanying drawings in which.

DETAILED DESCRIPTION OF THE PREFERRED EMBODIMENT

Figure 1:
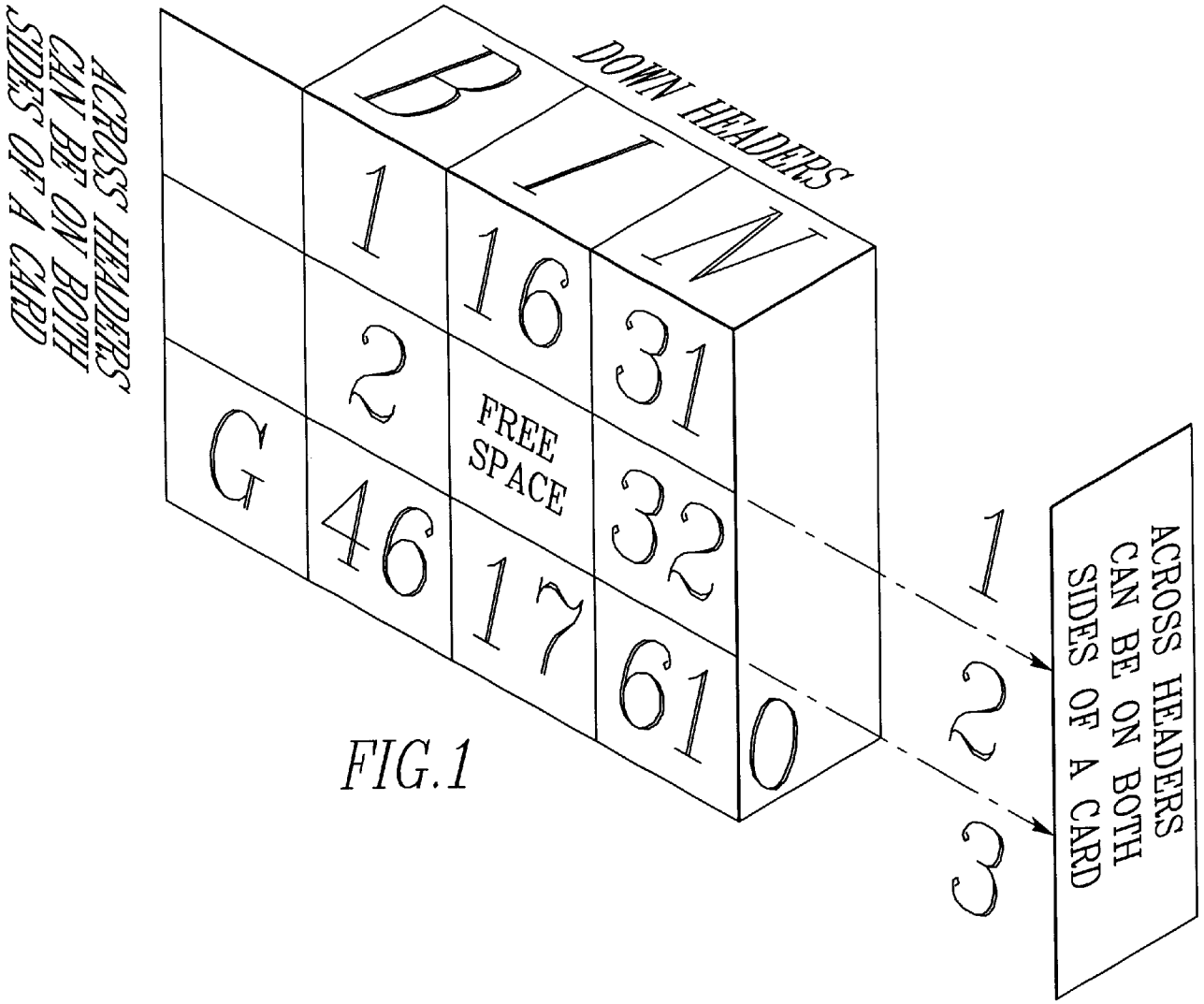
FIG. 1 is a schematic view of one matrix, which may be used in one embodiment of the method of the present invention.
Figure 2:
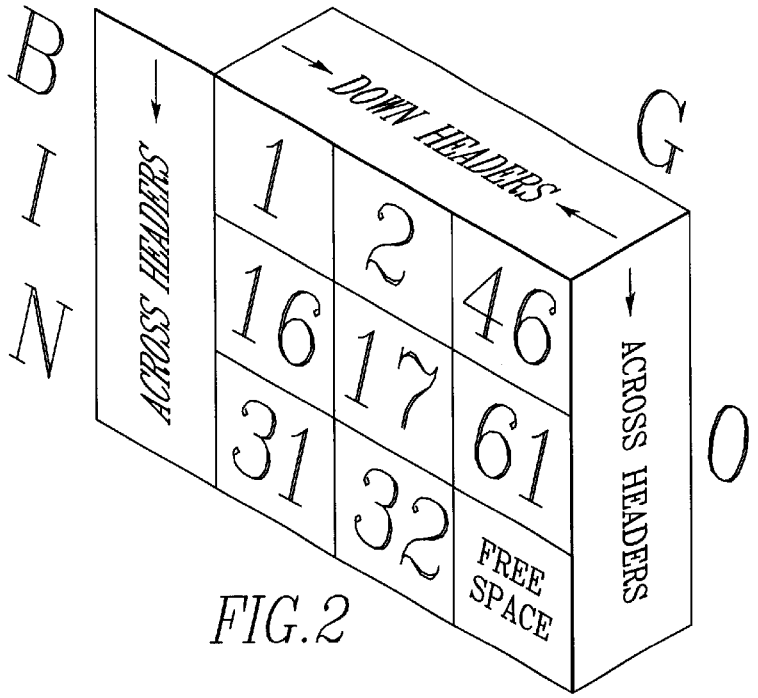
FIGS. 2 and 3 are schematic views of other matrices, which may be used in the practice of this application.
Figure 3:
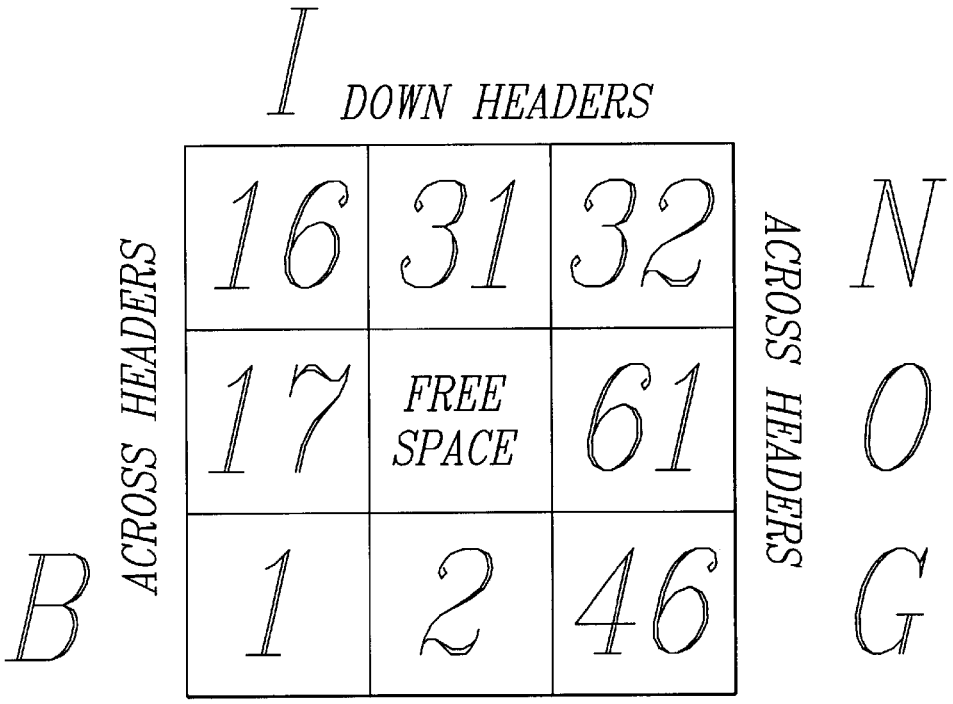

Referring to FIGS. 1–3, this matrix may be used in a card or on a video screen. In this matrix, the letters, i.e. "B", "I", "N", "G" and "O" are used not only on the columns but also on the rows. For example, in FIG. 1, "B", "I" and "N" are on columns and "G" and "O" are on opposite sides of a single row. In FIG. 2, "B", "I" and "N" are on the rows and O is on the opposite side of the middle row from "I" and "G" is on a column. In FIG. 3, "B" and "G" are on opposed sides of the bottom row and "N" and "O" are on other rows with "I" being on one column.

Pick-N-Choose any two (2) numbers from any three (3) B-I-N-G-O columns and one (1) number from each of the two (2) remaining B-I-N-G-O rows. At the same time U-Pick numbers, U-Choose the DOWN or ACROSS 3 BY 3 card line space (box) U wish to place the picked numbers. The two (2) number column picks must be placed on the same line DOWN or ACROSS. Once player picked numbers are in place in the chosen spaces (boxes) on the 3 BY 3 card, the bingo headings and free space appear. Players actually pick eight (8) numbers total; two (2) numbers from three (3) B-I-N-G-O columns and one (1) number from the remaining tow (2) B-I-N-G-O columns and then choose the exact space (box) location each picked number is placed on the 3 BY 3 card. No other speed bingo game lets you Pick-N-Choose the exact bingo numbers and card's space (box) location.

Players are unable to activate a 3 BY 3 bingo card if improper DOWN and ACROSS number or space (box) alignment is not chosen correctly. If a player makes a mistake selecting Pick-N-Choose numbers and card space (box) location of numbers, the electronic program enforces the game rules. Once the numbers and bingo spaces (boxes) are in proper alignment on a 3 BY 3 card, the free space and DOWN and ACROSS headings appear. You can play the card or drop the card to Pick-N-Choose numbers and cards by touching the drop card button. Once players have selected their numbers and card space (box) locations, players enter that card for the next game by touching the play button. This activates that card in the next gave and $0.25 is deducted at that time from players credits. Players can play one (1) card or up to four (4) cards in any one (1) game, for $0.25 per card. Players can also pay an additional $0.25 progressive jackpot fee per card. If one plays the progressive jackpot, "ALL" played cards are charged $0.25 per card, additionally, the $0.25 per card progressive jackpot fee amount must be available and paid for "ALL" played cards. If a player activates the progressive jackpot in any game "ALL" played cards pay $0.25 per card. The money is deducted automatically for "ALL" cards played in that game. For example, if a player is playing three (3) cards, $0.75 has been paid to play that 3 BY 3 bingo game, and if player elects to play progressive jackpot, an additional $0.75 is automatically deducted from credits when the progressive jackpot button is touched or activated in that game. If player has only $0.50 worth of credits, the progressive jackpot feature will not activate until enough credits are available to play progressive jackpot on all three (3) played cards as demonstrated in this instance.

3 BY 3 Pick-N-Choose is an exciting bingo game that allows players to pick a fixed variation of eight (8) Bingo numbers and select the exact space (box) those picked numbers can be located on the 3 BY 3 bingo card. The actual bingo game is played on a 3 BY 3 (grid) bingo card rather than a standard 5 by 5 (grid) bingo card that only utilizes all DOWN headers and a center card free space. The 3 BY 3 bingo card used DOWN and never before used ACROSS headers (located on the side of the 3 BY 3 card) and players choose the free space location on the 3 BY 3 card. This enables 3 BY 3 bingo participants to play high speed, consolidated three (3) spot in-line regular bingo. Regular 3 BY 3 bingo only requires three (3) numbers or two (2) numbers and the free space in straight line to accomplish or go bingo. It also offers condensed special pattern bingo games, (i.e., cover all, X pattern, corners, etc.). The optional pari-mutual progressive jackpot is available on all 3 BY 3 bingo games. The game may be played on Super VGA touch screen monitors displaying activated player created Pick-N-Choose 3 BY 3 cards or optional electronic Quick Pick cards. Players choose and can activate form one (1) to four (4) cards. The displayed cards and the bingo game real-time graphic video animation of each separate game generated (as the game is actually being played in cybernation from start to finish) is transmitted and networked to card activated player terminals from a designated central location. The system-wide cybernation program commands and functions include and are not limited to the following automatic features:

EXAMPLE

1. Activation or a player terminal by the insertion and acceptance of money into the bill acceptor that post credits for play at that player terminal.
2. A player terminal activated with credit will not display the transmission of a game in progress or a game not played. Players can create (Pick-N-Choose) cards or change cards when no bingo game is being player at that player terminal.
3. The time count down is displayed as to when the next available game start time is assigned.
4. Each game is assigned a start time for the next game at the end of a game.
5. Each game is assigned and has its own game and session identification number by date.
6. The push of the play button and debit of the $0.25 fee activate each 3 BY 3 card generated for play. The card is only then incorporated in the next available bingo game and a paid participating card of that game.
7. The optional pari-mutuel progressive jackpot is available for only ALL played cards in a game for a $0.25 per card fee.

EXAMPLE

8. There is a one (1) minute pre-game activation cut-off to record system wide security and register the verification of all activated (played) cards before the start of every game.
9. The record and accounting of the played cards in every game are computed for pari-mutuel prizes. Each individual game revenue and progressive jackpot revenue are pari-mutuel pooled separately. Fees and prizes are calculated for each game separately as well as the progressive jackpot carries over.
10. The bingo balls are electronically mixed and separately drawn buy a pure random number generator with no glitches. (No predetermined or created bill mixes are possible or ever used.)
11. The balls in each game are drawn with sound effects every five (5) seconds. The drawn ball is displayed with B-I-N-G-O column designation and number.
12. The drawn number is shown while it is simultaneously posted on the displayed bingo board and daubed (covered) on every active game card until a winning bingo is accomplished.
13. Accomplished bingo's are notified with sound and flashing winner graphics with the dollar amount that has been won.
14. Bingo cards that accomplish a winning bingo in a game are noticed system-wide and the amount won is credited to the player terminal where the winning card or cards were played.
15. Prize calculations are based on pari-mutuel prize pool funds as well as a separate pari-mutuel progressive jackpot pool with carryover provisions built in.
16. When a bingo is accomplished, that game is over and the next available game start time is posted system-wide.

The game cyberation program and process accomplishes the following:

(a) the system-wide terminal graphic player (b) electronic commands that complete the card acceptance for play (c) calculate the mathematics and the administration of both the pari-mutuel bingo pool in each game and the ongoing pari-mutuel progressive jackpot pool (d) collection and pay of fee and prizes (e) the network transmission and conducting of the real-time actual game generated (f) called numbers being automatically posted to the bingo board and daubed (covering of called numbers) on active bingo cards (g) notification of accomplished bingo's by location and amount won; and (h) full security and recorded integrity of each game.

3 BY 3 Pick-N-Choose Bingo may be adapted to be a cybernated networked game engineered and systemed to generate fast play and automatic card cover, daubing. Such a bingo game 3 BY 3 and system provide continual exciting high speed bingo in typical venues for such games such as Indian reservation locations or charity halls. The game can also operate on the worldwide web via the Internet. The electronic enhanced player terminals eliminate the need and waste of paper and daubers while stream lining the game to one or unlimited locations with complete accuracy and total security for player enjoyment of high stakes pari-mutuel high speed 3 BY 3 bingo. The 3 BY 3 Pick-N-Choose bingo game enforces and permits player terminals to accomplish cybernation so players are electronically playing bingo at a location that is different from the actual location the game is being conducted, without paper, and that automatically daubs or covers the exact numbers called in that game on their cards. Players gain immediate notification of possible and actual bingo's at their player terminal even though the game is conducted at a different location many miles away. The communication network of real-time interactive 3 BY 3 bingo electronically places players in the same game from different locations by virtue of the same cyberspace location that the actual game is being generated or conducted. The 3 BY 3 real-time cybernation bingo and pari-mutuel system conforms to the National Indian Gaming Regulatory Act of 1988 for operation as Class II. Cybernation is the use of computers coupled with automatic machinery to control and carry out complex operations.

Each game has a specific game and session number by date and pattern (three (3) spot straight in-line bingo, corners, X-game, cover all, etc.). All player-activated cards are recorded and registered in each game the card participates. All player terminals are networked and connected to a system-wide single electronic ball drawing random number generator that allows all the players to compete in a specific cybernation game for a common pari-mutuel prize pool. Each and every played card is charged $ 0.25 and registered electronically in that actual game. A $0.25 per card optional progressive jackpot is available. Every game is played on the real-time of the location the actual game is generated or conducted. An electronic random number generator ball drawing system of the 75 or optional 90 bingo numbers is security activated to accomplish the card registration and ball drawing in every game.

3 BY 3 Pick-N-Choose bingo incorporates the latest technology in satellite, fiber optic and high-speed telecommunications equipment to network potentially thousands of player terminals in multi-state bingo halls throughout the USA or world. The pari-mutuel prize polls of the networked bingo halls will allow the offering of large, promotionally attractive player prizes. This will surely increase bingo attendance across the country.

The 3 BY 3 Pick-N-Choose bingo game incorporates multi-features for player enjoyment and confidence. Cybernation features of the network can be enhanced to customize pari-mutuel prize poll payouts and progressive jackpots in each separate location or target groups (i.e. clubs, fraternal organizations specific fund raisers, Elks and Moose lodges). The game can be set to an exact payout or hold pari-mutuel pool for a single or group customized location hall separate form the network system. This customized percentage payout and hold can be different than the networked game percentages with notice and security. The system-wide networked games are set to the same exact percentage payout and hold to encourage cybernation conformity and larger pari-mutuel prize pools. Customized and specific organizational find raising pools are important to the 3 BY 3 Pick-N-Choose cybernation program. Cybernation allows one (1) single game (generated) presentation for a multitude of separate pari-mutuel prize fund pools to stay (be located) in separate jurisdictions if necessitated by law. Horse racing simulcasts accomplishes the pictured race transmission but does not complete or perform the program cybernation functions that the 3 BY 3 Pick-N-Choose bingo game invented.

Each played card for each game played is $0.25. All played cards for an additional $0.25 per card can enter a separate pari-mutuel progressive jackpot pool. If a player accomplishes a two (2) numbers called bingo, it pays a minimum $100.00 progressive jackpot. An ongoing mini jackpot is also available out of the progressive jackpot poll with a carryover jackpot pool. A minimum of one (1) card and a maximum of four (4) cards can be played in a 3 BY 3 Pick-N-Choose bingo game.

3 BY 3 Bingo plays straight three (3) in-line bingo (which includes two (2) called numbers and the free space) or special games with no ante losses or game drops. Every straight in-line bingo game card is a potential winner in two (2) called numbers. 3 BY 3 bingo offers pari-mutuel progressive jackpots in every game. Correct actual percentages of pari-mutuel bingo pool winnings are always exact and are based on the revenue generated in each game with built in security and system integrity.

Players can purchase from one (1) to four (4) 3 BY 3 Pick-N-Choose bingo cards in any game for a $.25 per card cost. (A minimum card cost is $0.25 or up to $1.00 if all four cards are purchased for a bingo game only.) A pari-mutuel progressive jackpot option can only by purchased for the exact number of cards purchased in any game. (If a player purchases four (4) cards in a game and wishes to purchase the optional jackpot enhancement, player must purchase the jackpot feature for all four (4) cards. The jackpot option is $0.25 per card played in that game.) Player cannot split the jackpot feature on certain cards. It is "ALL" cards played or none in every game covered (activated) by the pari-mutuel progressive jackpot.

Players activate a selected terminal position by inserting $1.00 to $100.00 in the bill acceptor. Credits in $0.25 increments will appear on the terminal screen. Select the game you wish to play. Depending on player terminal bingo hall locations a choice of games may vary from time to time. If you are a new player, check with the hall attendants for assistance and directions. When playing 3 BY 3 Pick-N-Choose bingo, the player selects two (2) numbers from three (3) B-I-N-G-O columns and one (1) number from each of the remaining two (2) B-I-N-G-O columns, and chooses the placement (box) location on the 3 BY 3 bingo card. Once the player number choices are installed on the card (boxes) properly, the free space and Down and Across headings appear. A player can change any card by pressing the drop button and start the Pick-N-Choose procedure again. When the player is satisfied with the 3 BY 3 card a touch of the play button activates that card for the next game and deducts a $0.25 fee from the players credits posted. Player cards remain the same on the player terminal until player drops that card and Pick-N-Choose new numbers and card positions.

When the game is about to begin, a count down signals the time left to Pick-N-Choose. Once the player's card is constructed, the player depresses the play button, a $0.25 charge is debited to players posted credits. At first it may take a few minutes to acquaint the player with the Pick-N-Choose number and card selection process, but it is simple once the player is familiarized with the player terminal buttons and/or touch screen. Player also have the option to hit the "quick pick" button on any card. The "quick pick"

will actually cause an automatic pick or random numbers and card location for ready play. It's the same as the play button, but player makes no selections of Pick-N-Choose numbers and card position. The progressive jackpot feature can be activated on "quick pick" cards the same as if the player Pick-N-Choose the card or cards. Promotions can be used by giving free progressive jackpot play on selected games. The no charge progressive jackpot feature can build initial play on the game. A first two (2) ball bingo pays a minimum $100.00 when the progressive jackpot feature is activated on a winning card.

The 3 BY 3 Pick-N-Choose Bingo includes any and all possible number and card combinations for any and all number locations and combinations in 75 number bingo and optional 90 number bingo on the 3 BY 3 Pick-N-Choose card (grid). This game a 3 BY 3 box (grid) that allows for headings in any location or sequence of "B-I-N-G-O" Down or Across with all the numbers 1 to 15 "B's", 16 to 30 "I's", 31–45 "N's", 46–60 "G's", 61 to 75 "O's" and one free space in a box on the 3 BY 3 box (grid). The optional 90 number bingo game follows the same patterns on the 3 BY 3 Pick-N-Choose bingo card.

When the time alert clock to start a game reaches zero seconds, the player cannot play any card in that game nor can the optional progressive jackpot feature be activated for play. The player can Pick-N-Choose cards for the next game. When the game begins, the first ball is drawn and displayed. The animated mini-ball blower on the screen shows the balls bouncing and then the drawn ball comes up to the display tray in that game. Noise of the ball through the tube is a suction noise to a pop blow-up of the actual ball that was drawn. The balls are drawn every five (5) seconds until a Bingo on the 3 BY 3 game is accomplished.

Player terminals NOT activated for a game do not display the game. Terminals that have posted credits on screen can Pick-N-Choose number and card layouts. Once the play button is touched or activated that card is entered into the next game automatically. Player continues to enter additional cards and have the option to add the progressive jackpot to "All" the played cards from (1) to four (4) in any game. Cards are locked in the network for the very nest game. When the zero seconds run down to begin the next game, whatever games the player has paid for is locked into that game. No more cards can be played nor can the optional progressive jackpot feature be added. There is approximately two (2) minutes between each played game to change and drop cards. Player must always touch the play button in every game to activate a card. If the progressive jackpot was activated in the previous game, it will be automatically activated and charged the $0.25 fee per card on "All" played cards when you touch or activate the play button. The same play is repeated from the previous game unless the player hits the drop button. What the player played in the previous game is automatically played in the next game unless the player drops the card. Then the player must complete all steps on the screen to play again. The only time players are participating in a game is when the play button for a specific game is activated and money is collected for that game.

Once balls have begun to appear on the drawn tray, they are the official bingo balls and numbers drawn in that cybernation game. The balls are drawn from the designated central location (home site) generating the actual game, and at the same real-time transmitting electronic program commands to each activated player station that complete the cybernation graphic result and effect of the drawn ball and daubing of called numbers in that game. Bingo alignment, notification of pending Bingo's and actual Bingo's accomplished happen in microseconds. The automatic daubing or covering of called numbers and accumulations of winning credit is all an automatic function of cybernation game play of the network. The transmitted generated game to player terminals is accomplished by displayed graphics to the exact location and player terminal the 3 BY 3 game is being played pari-mutuel prize pools are calculated and based on the number of participating players in that game. Minimum $25.00 per game prizes are generated. The progressive jackpot carry-over pool climbs per game based also on number of participants who played the optional progressive jackpots. The actual prizes are pari-mutuel pooled and posted on each game screen terminal for that bingo game. Players collect credits that are accumulated by touching the print payout ticket. Each player terminal has a ticket printer or an attendant to pay players for the posted credits which to be cashed in. The location of the game generation that is networked and linked by cybernation real-time is referenced as the host site.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. A method of playing a game similar to bingo comprising the steps of:

(a) providing a matrix having an array comprising three columns of elements and three rows of elements, said columns and rows being arranged such that each of said elements is simultaneously included in one of said columns and one of said rows and is positioned adjacent at least two other of said elements so as to form primary predesignated sets, and each of said columns has at least one header space and each of said rows has a pair of side header spaces and one of a plurality of five letters is positioned in at least some of said column or row header spaces, and at least some of said elements have a designation which is a numeral and at least some of the elements have a composite designation selected from the numeral of said element and one or more letters in the row or column of said letter, and a player selects at least some of the designations of the elements;

(b) causing the player to be associated by a physical means with the matrix by having said player assigned to a position adjacent the matrix; and (c) generating a random set of elements by identifying a plurality of combinations of letters and numbers and declaring a winning combination when any of said random sets of elements matches any one of the primary predesignated sets of elements, and wherein if the random set of elements generated in this step does not match any one of the primary predesignated sets of elements, further random sets of elements are successively randomly generated until one of said further random sets of elements matches any one of the primary predesignated sets of elements and the player wins when one of said random sets of elements matches any one of the primary predesignated sets of elements.

2. The method of claim 1 wherein the letters are B, I, N, G and O.

3. The method of claim 1 wherein the matrix contains a FREE space.

4. The method of claim 1 wherein there are letters on both of the opposed header spaces of one of the rows.

5. The method of claim 4 wherein each of the column header spaces has a letter.

6. A method of playing a game similar to bingo comprising the steps of:

(a) providing a matrix having an array comprising three columns of elements and three rows of elements, said columns and rows being arranged such that each of said elements is simultaneously included in one of said columns and one of said rows and is positioned adjacent at least two other of said elements so as to form primary predesignated sets, and said matrix has opposed top and bottom sides and opposed lateral sides and there are three columns or rows of header spaces adjacent three of said sides, and said header spaces contain five letters positioned adjacent at least some of the rows or columns, and at least some of said elements have a designation which is a numeral and at least some of the elements have a composite designation selected from the numeral of said element and one or more letters in the row or column of said letter, and a player selects at least some of the designations of the elements;

(b) causing the player to be associated by a physical means with the matrix by having said player assigned to a position adjacent the matrix; and (c) generating a random set of elements by identifying a plurality of combinations of letters and numbers and declaring a winning combination when any of said random sets of elements matches any one of the primary predesignated sets of elements, and wherein if the random set of elements generated in this step does not match any one of the primary predesignated sets of elements, further random sets of elements are successively randomly generated until one of said further random sets of elements matches any one of the primary predesignated sets of elements and the player wins when one of said random sets of elements matches any one of the primary predesignated sets of elements.

7. The method of claim 6 wherein the letters are B, I, N, G and O.

8. The method of claim 6 wherein the matrix contains a FREE space.

9. The method of claim 6 wherein there are letters on opposed header spaces adjacent one of the rows.

10. The method of claim 9 wherein each of the column header spaces has a letter.

* * * * *